US012378730B2

(12) United States Patent
Svensson

(10) Patent No.: US 12,378,730 B2
(45) Date of Patent: Aug. 5, 2025

(54) RAIL CLAMP HANDLING ARRANGEMENT

(71) Applicant: UTV Center AB, Kil (SE)

(72) Inventor: Robin Svensson, Kil (SE)

(73) Assignee: UTV CENTER AB, Kil (SE)

( * ) Notice: Subject to any disclaimer, the term of this patent is extended or adjusted under 35 U.S.C. 154(b) by 584 days.

(21) Appl. No.: 17/798,413

(22) PCT Filed: Feb. 12, 2021

(86) PCT No.: PCT/SE2021/050121
§ 371 (c)(1),
(2) Date: Aug. 9, 2022

(87) PCT Pub. No.: WO2021/162624
PCT Pub. Date: Aug. 19, 2021

(65) Prior Publication Data

US 2023/0093743 A1 Mar. 23, 2023

(30) Foreign Application Priority Data

Feb. 13, 2020 (SE) ..... 2050153-2

(51) Int. Cl.
*E01B 29/24* (2006.01)
*E01B 29/32* (2006.01)
*E01B 9/60* (2006.01)

(52) U.S. Cl.
CPC ..... *E01B 29/24* (2013.01); *E01B 29/32* (2013.01); *E01B 9/60* (2013.01)

(58) Field of Classification Search
CPC ..... E01B 29/24; E01B 9/60; E01B 29/32
(Continued)

(56) References Cited

U.S. PATENT DOCUMENTS 2,037,701 A * 4/1936 Bronander ..... E01B 29/24 74/411
5,839,377 A * 11/1998 Brenny ..... E01B 29/24 104/17.2

(Continued)

FOREIGN PATENT DOCUMENTS

FR 2876120 4/2006
FR 2878866 6/2006

(Continued)

OTHER PUBLICATIONS

European Search Report issued in EP 21754199.4, Feb. 14, 2024, pp. 1-8.

(Continued)

*Primary Examiner* — Zachary L Kuhfuss
(74) *Attorney, Agent, or Firm* — Jeffrey S. Melcher; Melcher Patent Law PLLC

(57) ABSTRACT

This invention relates to rail clamp handling arrangement, for moving a clamping element (300) from a position in which said element fastens a rail (800) to a railroad sleeper to a sleeper releasing position and vise-versa, comprising a support structure/housing (500) having a lower part (501) with a central rail fit member (503) and arranged to extend transversally in relation to the longitudinal extension of the rail (800), wherein at each outer end portion (504) of said lower part (501) there is arranged connection means that provide pivot points (401) at an intermediate point of a pivotable lever arm (400), said lever arms (400) being arranged mirror symmetrically, a power and transmission arrangement (2, 3, 6) arranged to simultaneously move an upper part (405) of said lever arms (400) via an upper pivotal connection (402), a lower part (406) of said lever arms (400) comprising contact devices (403) arranged to move a clamping element (300), wherein said power and transmission arrangement (2, 3, 6) includes a power unit in the form of an (Continued)

electric motor (2) and a rotatable threaded shaft (6) arranged to transfer torque applied via said power and transmission arrangement (2, 3 6) into pivotal movement of said lever arms (400).

9 Claims, 4 Drawing Sheets

(58) Field of Classification Search
USPC ..... 104/17.2
See application file for complete search history.

(56) References Cited

U.S. PATENT DOCUMENTS

| | | | | |
|---|---|---|---|---|
| 6,134,775 | A * | 10/2000 | Castillo | B27F 7/155 29/772 |
| 12,194,553 | B2 * | 1/2025 | Svensson | B23Q 9/0028 |
| 2006/0130697 | A1 | 6/2006 | Hertelendi | |
| 2021/0308779 | A1 * | 10/2021 | Svensson | B23Q 9/0007 |

FOREIGN PATENT DOCUMENTS

| | | |
|---|---|---|
| SE | 514262 | 1/2001 |
| WO | 00/36219 | 6/2000 |
| WO | 2012067575 | 5/2012 |

OTHER PUBLICATIONS

International Search Report Issued in PCT/SE2021/050121, Mar. 3, 2021, pp. 1-4.
Written Opinion Issued in PCT/SE2021/050121, Mar. 3, 2021, pp. 1-5.

* cited by examiner

RAIL CLAMP HANDLING ARRANGEMENT

TECHNICAL FIELD OF THE INVENTION

The present invention relates to a rail clamp handling arrangement.

BACKGROUND

Several different embodiments of arrangements for bringing a clamping element fastened to a railroad sleeper and forming part of a clamping unit to a position in which it fastens said rail section to said sleeper are known in the art.

Example of conventional such arrangements are found in U.S. Pat. No. 3,690,264, WO95/13427 and WO99/24669.

These arrangements include large structures carried by wheel equipped wagons intended to be moved along a rail track. As is evident such an arrangement is heavy, and it is therefore a need for lifting machines to move it onto and away from a rail track. Also smaller arrangements is known for bringing a clamping element fastened to a railroad sleeper, but also these known arrangements are relatively heavy and will therefore need some kind of lifting aid for movement thereof.

SUMMARY OF THE INVENTION

The object of the present invention is to provide a solution to the issues mentioned above by providing an improved rail clamp handling arrangement, as well as an improved method for handling clamps.

The object according to the invention is achieved by a rail clamp handling arrangement according to claim 1.

Thanks to the invention a rail clamp handling arrangement is provided that is substantially lighter than prior art machines, enabling a single person to carry the machine. Further, the invention in the basic principle may completely utilize mechanical drive, which provides an environmental advantage compared to prior art machines that conventionally use hydraulics.

Further beneficial aspects of the invention are apparent from the description and also from what is defined in the dependent claims.

BRIEF DESCRIPTION OF THE DRAWINGS

The invention will be described in more detail in the following with reference to the accompanying drawings, which for the purpose of exemplification illustrate a schematic embodiment of the invention and some basic details of the power and transmission arrangement.

DETAILED DESCRIPTION

The invention provides a rail clamp handling arrangement 100 of a lightweight kind that may be lifted and moved by one person, possibly without use of any lifting aid.

Figure 1:
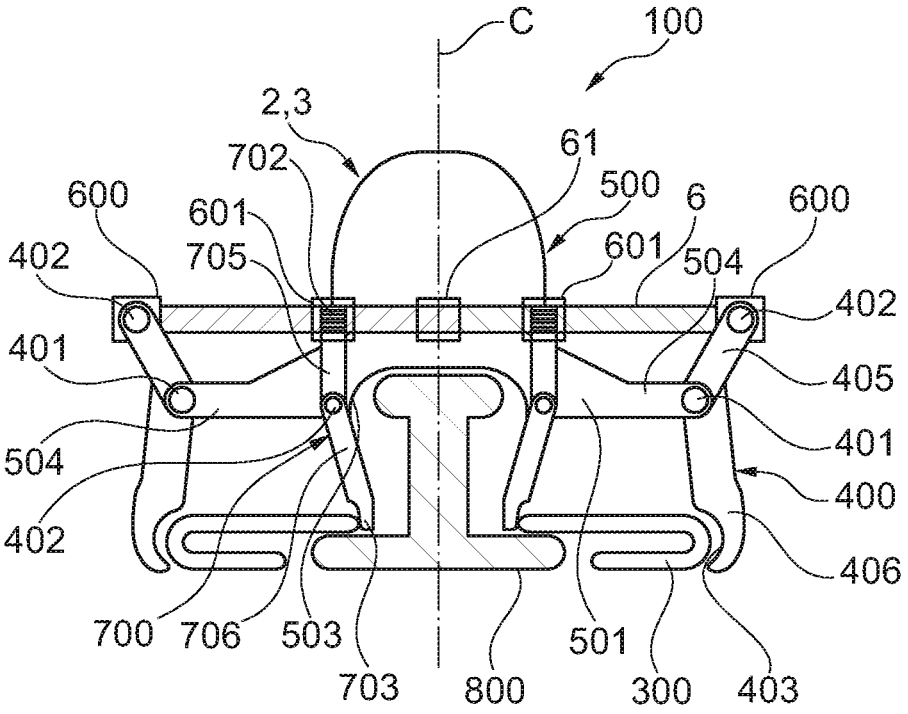
FIG. 1 schematically shows a front view of a schematic embodiment of a rail clamp handling arrangement according to the invention, in a position for moving clamping elements to retain a rail, FIG. 2 schematic shows a side view of a part of the embodiment of FIG. 1, but without a housing.
Figure 2:
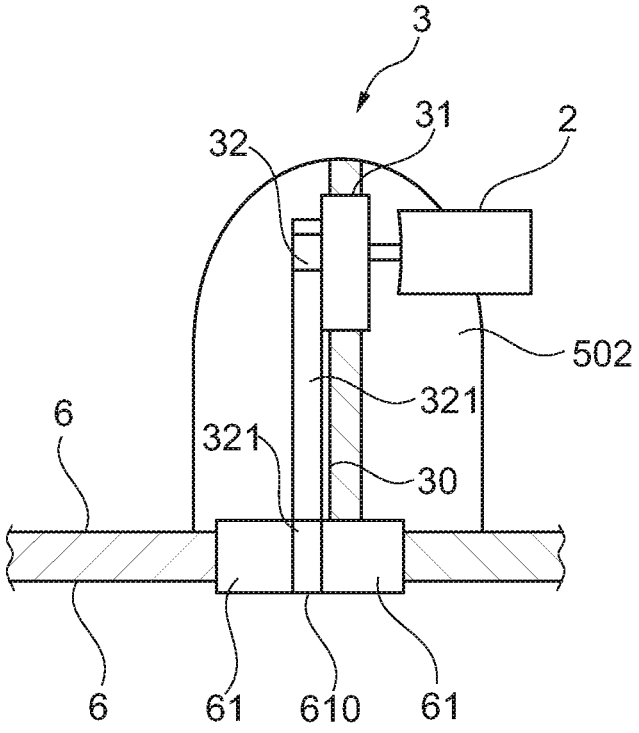

In FIGS. 1 and 2 there are shown schematic views of a rail clamp handling arrangement 100 according to the invention. There is shown a rail 800 that is attached to the ground in a traditional way by means of clamping elements 300.

The rail clamp handling arrangement 100 comprises a support structure 30, 501, 502, preferably covered by a housing 500 The support structure 30, 501, 502 includes a lower part 501 and an upper part 502 horizontally extending in a transvers direction in relation to the extension of the rail 800. Further, the support structure includes a fixed support wall 30 (schematically shown in FIG. 2) attached to the upper part 502 and horizontally extending in a transverse direction in relation to the upper part 502. A motor 2 and a first part 31 of a transmission is attached to the support wall 30. The first part 31 of the transmission has an output shaft 32 that drives a chain 321 (or belt, see FIG. 2).

The lower part 501 of the support structure extends symmetrically in the transversal direction in relation to the fixed support wall 30 and the longitudinal extension of the rail 800, i.e. mirror symmetrically in relation to a central plane C. The lower part 501 of the support structure, at each outer end portion 504 is arranged with connection means (e.g. through holes provided with shafts) that provide pivot points 401 for first lever arms 400, that are arranged mirror symmetrically. The pivot points 401 are arranged at an intermediate position of each first lever arm 400. Further the lower part 501 of the support structure, at a position inside of the outer portion 504 is arranged with connection means (e.g. through holes provided with shafts) that provide pivot points 402 for second lever arms 700, that are also arranged mirror symmetrically. The pivot points 401 are arranged at an intermediate position of each second lever arm 700.

The power and transmission means 2, 3 rotatably drives a threaded shaft 6 included in the invention. The threaded shaft 6 is rotated by means of a drive sleeve 61, that has a fixed central position in relation to the support structure 501, 502, e.g. within the housing 500, by means of bearings (not shown). The shaft 6 is positioned such that the driving sleeve 61 is at the centre of the extension of the drive shaft 6. A substantial portion of each threaded shaft 6 will protrude on each side of an upper part of the housing 500.

At each outer portion of the threaded shaft 6 there are positioned first displacing nuts 600 which also interfit with the threaded shaft 6. The displacing nuts 600 are attached to one first lever arm 400 each, by means of an upper pivotal connection 402 arranged adjacent the upper end of an upper part 405 of each lever arm 400.

At the other end of the first lever arm 4, adjacent a lower end of a lower part 406 of the first lever arm 400, there is arranged a contact member 403 for active contact with a clamping element 300.

Further at intermediate positions, between the sleeve 61 and the first displacing nuts 600, there are positioned second displacing nuts 601 which also interfit with the threaded shaft 6. The second displacing nuts 601 are attached to an upper part 705 of each second lever arm 700 each, by means of an upper second pivotal connection 702 arranged adjacent the upper end of the upper part 705 of each second lever arm 700.

At the other end of the second lever arm 700, adjacent a lower end of a lower part 706 of the second lever arm 700, there is arranged a contact member 703 for active contact with a clamping element 300.

The threads of the threaded shaft 6 are arranged mirror symmetrically on each side of the driving sleeve 61. Accordingly, the contact members 403, 703 of the lever arms 400, 700 will move towards or away from each other dependent on the direction of rotation of the shaft 6. Thanks to having exactly the same configuration, but mirror symmetrically, the movement will be synchronized on both sides, i.e. moving the contact devices 403,703 outwards simultaneously or inwardly simultaneously.

Hence, when driving the transmission in a first direction the contact members 403 of the first lever arms 400 may be used to push clamps 300 into clamping action for a rail 800, whereas when driving the transmission in a second direction the contact members 703 of the second lever arms 700 may be used to push clamps 300 into clamping action for a rail 800, thanks to providing a sufficient distance between each pair of facing contact members 403, 703 that enables the positioning of a clamp 300 in between. It is evident for the skilled person that merely one pair of lever arms 400 may suffice to both push clamps 300 into place and remove clamps 300, respectively, by adjusting the position of the contact members 403 to a desired position (inside of or outside of the clamps 300) prior to use.

Figure 3:
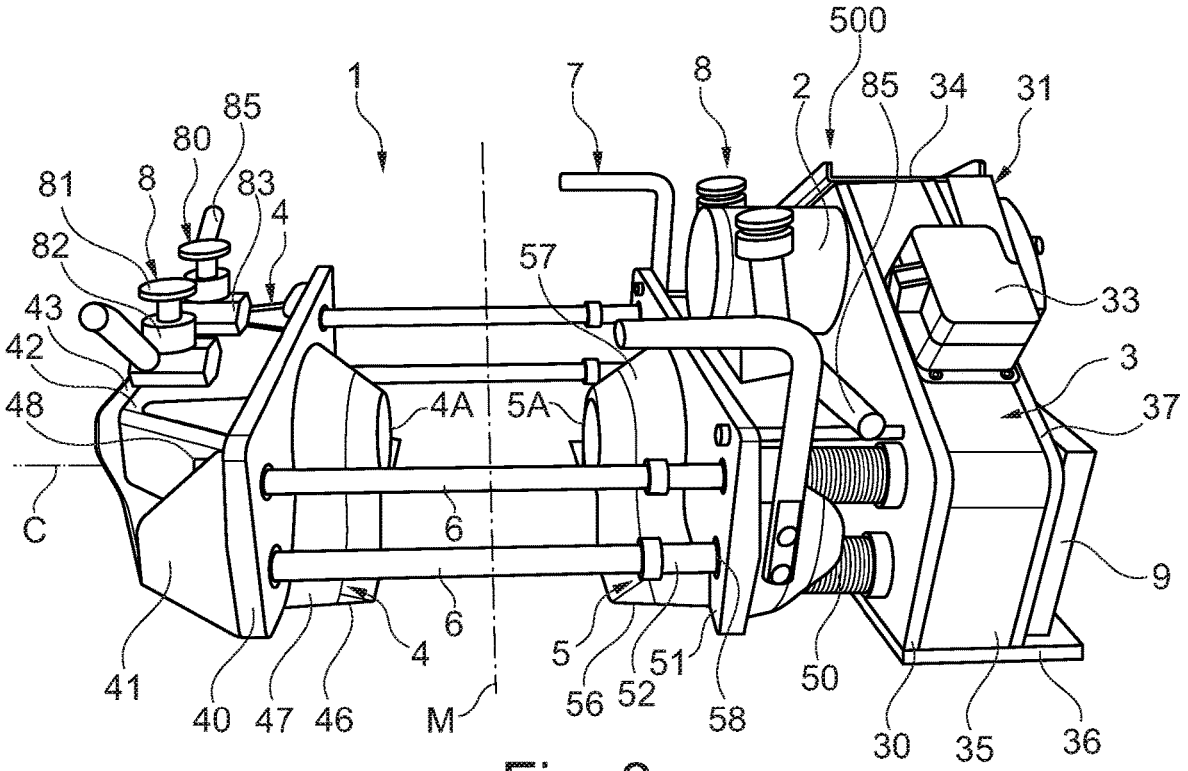
FIG. 3 shows a perspective view of a weld cutting machine that may be used together with some basic principles of the invention for cutting welds in connection with rails construction, used to exemplify and clarify some details of the concept that may be more or less the same also for the actual invention.

By use of basically the same power and transmission means 2, 3 for rotatably driving the threaded shaft 6 as is used for driving weld cutting jaws, as disclosed in PCT/SE2019/050523 the machine may be made substantially lighter than known machines. In the following the principle of using that power and transmission means 2, 3 will be described in relation to schematically revised figures used in PCT/SE2019/050523, i.e. originally showing a weld cutting machine. In FIG. 3 there is shown a perspective view of such a weld cutting machine 1 and in and in FIG. 4 there is shown a perspective view of an outgoing part 32 of a preferred transmission mechanism 3.

Figure 4:
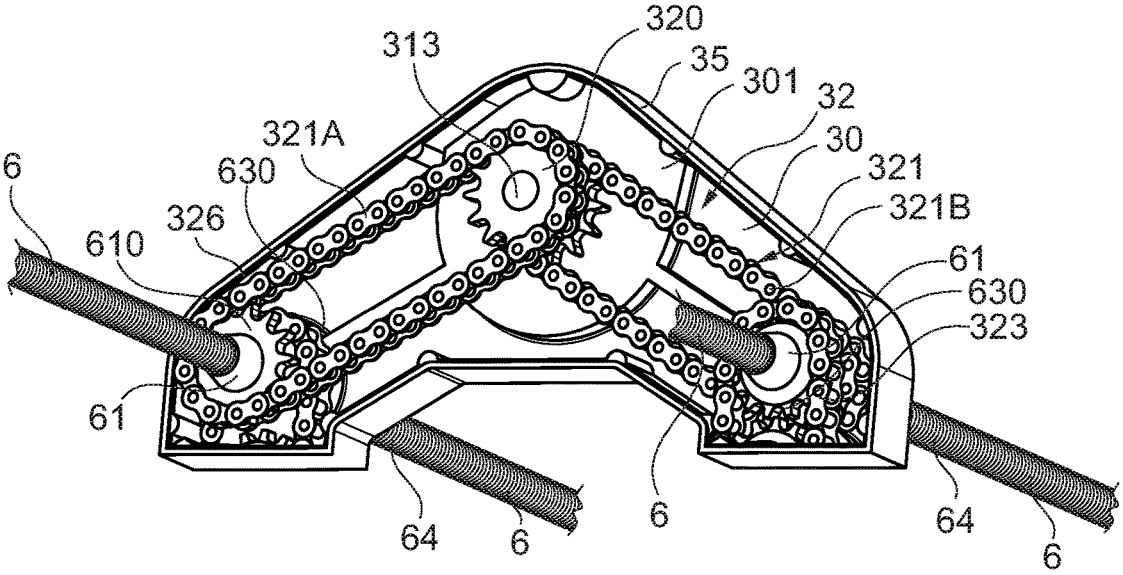
FIG. 4 shows a perspective view of a first part of a transmission of one embodiment that may be used in together with the invention.
Figure 5:
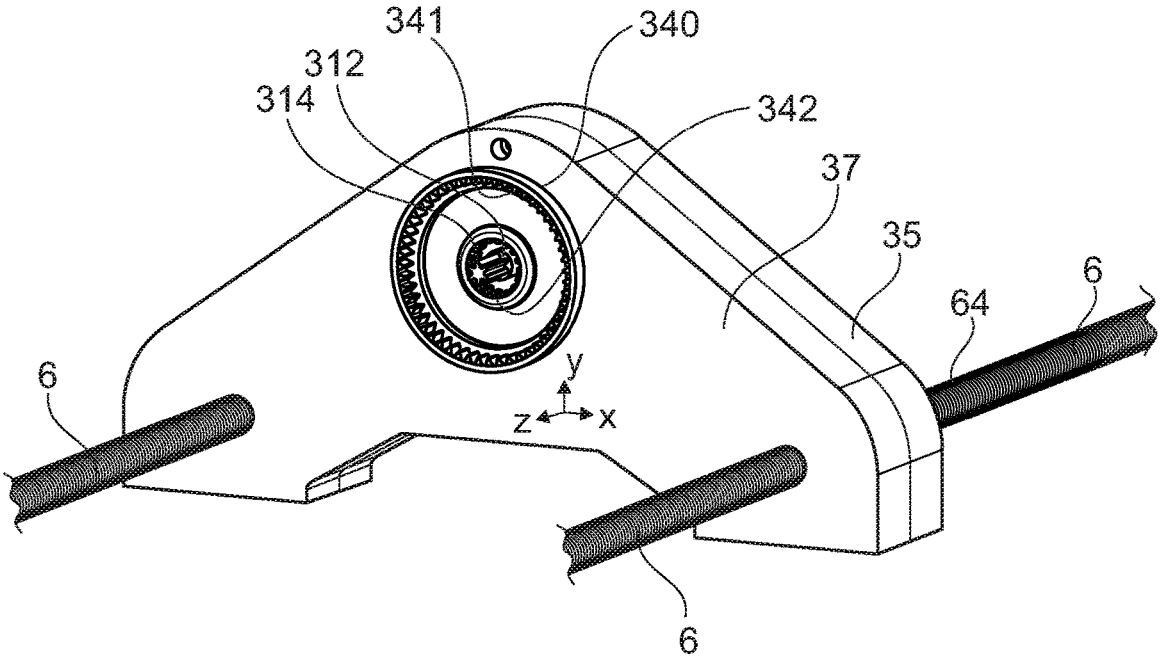
FIGS. 5 and 6 show perspective views of an embodiment of a second part of the transmission of a preferred embodiment according to the invention.
Figure 6:
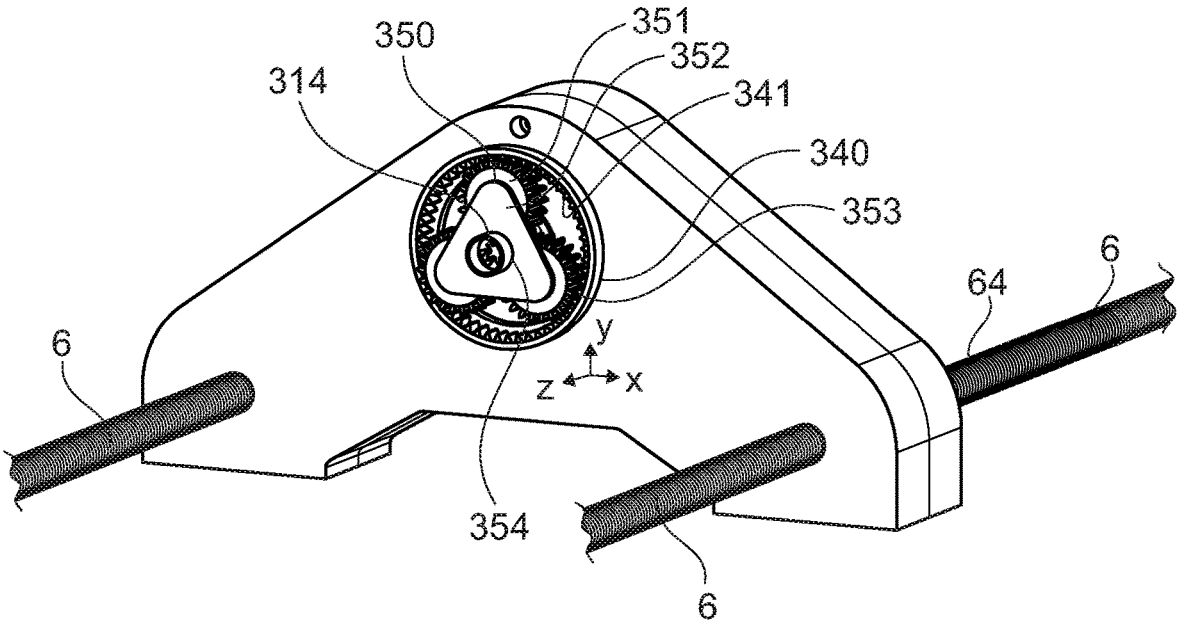
Figure 7:
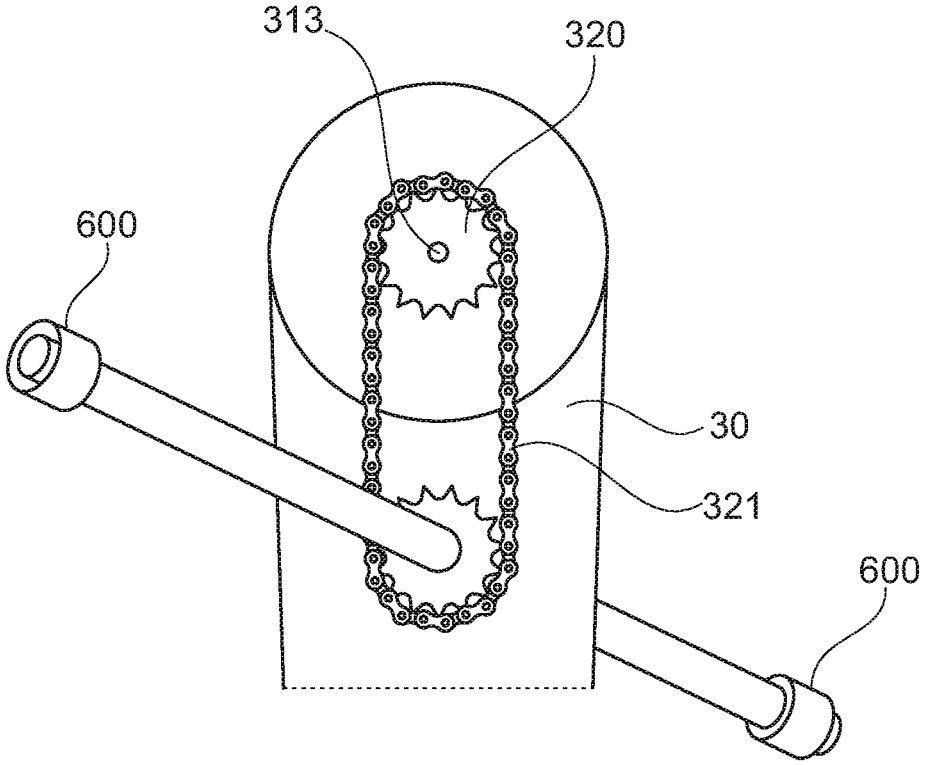
FIG. 7 shows a schematic view of a preferred embodiment of the invention.

It is to be noted that in a preferred embodiment according to the invention, see FIG. 7, there is merely needed one threaded shaft 6, i.e. not two shafts as shown in FIGS. 4, 5 and 6. It is evident that the skilled person will have no problem in understanding that a single shaft 6 may preferably be positioned centrally, i.e. below the central dented wheel 320 (shown in FIG. 4) and that then there will merely be needed one central dented wheel 320.

However, it is not excluded that two parallel shafts 6 may be of use in an alternate embodiment, i.e. having two parallel shafts 6 assisting in driving each lever arm 400.

A relatively small high-speed electric motor 2 operates the transmission mechanism 3 adapted for the purpose of providing a desired transmission.

The transmission mechanism 3 comprises, two parts. On the one hand, a planetary gear 31 (preferably including an arrangement, shown in FIGS. 5 and 6) driven by the output shaft 312 of the motor 2 and a chain/wheel mechanism 32 (see FIG. 2) driven by the output 342 from the planetary gear 31.

The drive shaft/s 6 extend along the same longitudinal direction as the motor 2 and as shown in FIGS. 1 and 2 in both directions away from the driving sleeve 61.

The driving sleeve 61 may be rotation wise fixed onto the shaft 6 by means of form fitting, e.g. splines. However, it is evident for the skilled person that the driving sleeve 61 may be fixed to the shaft 6 in various manners, e.g. by means of welding, fixation screws, etc. Further, it is evident for the skilled person that the shaft 6 will have to protrude the same distance on both sides of the driving sleeve 61 in accordance with actual invention, wherein the direction of the threads on each side of the driving sleeve 61 are opposite to each other. As a consequence, upon rotation of the drive shaft 6, the lever arms 400 will move in the desired directions either increasing or decreasing the distance between the contact members 403, depending on the rotational direction.

The support structure/housing 500 may include a separate housing 30, 35, 37 of the transmission mechanism 3, similarly as shown in FIG. 1. Inside, that housing or a common housing 500, there is a chain/wheel mechanism 32, which in the preferred embodiment will merely drive one drive sleeve 61 (see FIG. 7), i.e. to transfer torque from the chain/wheel mechanism 32 to the drive shaft 6.

The output shaft 312 from the planetary gear 31 may preferably have a fixed position within the support structure. There may preferably be arranged a transversal wall 30 providing support for bearings/parts of the transmission mechanism 3, e.g. a first supporting structure 301 for the motor 2 that is attached to an inner side of the transversal wall 30. Further there may be a second supporting structures 302, providing support for the drive member 61 of the drive shaft 6.

The output 342 of the planetary gear 31 drives a shaft having one central chain wheel 320 fixed thereto that drives the chain 321 that drives the chain wheel 610 attached to the driving sleeve 61. (Alternatively, if two shafts 6, one chain 321A drives an output chain wheel 610 at one side of the housing, and another chain 321B symmetrically positioned drives another chain wheel 630 at the opposite side of the upper part of the housing). The chain/wheel mechanism 32 thereby may transfers an output rotating torque to the (torque transmitting) drive sleeve 61 connected the shaft 6, which thereby moves the lever arms 400, 700 synchronously.

In FIGS. 5 and 6 the design of the planetary gear 31 is shown in more detail. The motor 2 and the planetary gear 31 are attached to opposite sides of the fixed support wall 30, i.e. the planetary gear 31 is attached to a first side of the support wall 30, whereas the motor 2 is attached to the second side of the support wall 30. Hence the output shaft 312 of the motor 2 passes through the support wall 30 through central passages 313 of the shaft with the central chain wheel 320.

At the outer end of the motor output shaft 312 there are dents forming a sun wheel 314 that mesh with dents 353 at the inner side of planet wheels 351 of the planet assembly 350. The planet assembly 350 includes three circular planet wheels 351 symmetrically attached to a planet carrier 352, having a central collar 354 providing support/bearing (not shown). Hence, the planet carrier 352 may rotate together with the planet wheels 351. The planet wheels 351 at their outer sides mesh with dents of a fixed ring wheel (not shown) and also with dents 341 of a rotatable ring wheel 340. The rotatable ring wheel 340 is non rotatably attached via dents 342 at its inner periphery to a shaft (not shown) carrying the two central chain wheels 320 and thereby drives the chain/wheel mechanism 32. In the preferred embodiment the planetary gear is a harmonic gear, i.e. the rotatable ring wheel 340 and the fixed ring wheel have different amounts of dents, e.g. 51 and 48 respectively, which provides for a drastic reduction of the rotational speed from the motor shaft 312 to the rotate able sun wheel 340.

In an exemplary embodiment the number of dents 314 of the motor shaft 312 is 6 and each planet (3 pcs) has 22 dents. In combination with a ring wheel (first outer ring) that is fixed having 48 dents and a rotatable ring wheel (second outer ring) having 51 dents there will be achieved a gear ratio of 1:153, i.e. when the sun wheel has made 9 turns, each planet has made one turn (360 degrees) and thereby have driven the rotate able outer ring 1/17 of a turn.

Thanks to the transmission mechanism 3 and its combination of the (preferably harmonic kind) planetary gear 31 and the chain/wheel mechanism 32, an extra reliable and compact torque transfer/rotational motion may be provided to the drive shaft/s 6.

The use of an electric motor 2 may further provide the advantage that an adaptive torque/speed is automatically created to the drive shaft 6, in that the higher the resistance the lower the transmitted speed to the drive rods 6, i.e. when the resistance increases the rotational speed is reduced and the torque of the motor 2 increases and thus the force that effect the moving lever arms 400, 700. Preferably an out board electric motor 2 is used that may provide a larger torque than traditional motors.

FIG. 2 indicates that there is a kind of support structure that fixates basics parts of machine 100, e.g. the electric motor 2, the fixed wall 30 of the chain/wheel gearing 32, the planetary gearing 31 and other parts that need to be fixated. Moreover, there may be a housing 500 that have grips/handles (not shown) attached thereto for ease of carrying and lifting the machine.

In operation of the machine is transported to a desired rail part, having clamping members 300 that are to be handled. The transportation may easily be performed by carrying the machine by hand. A protective plate may be arranged at the bottom of the gear wheel housing 30, 35, 37, or the larger housing 500, in order to enable the machine to be put down also on uneven ground without risk of causing damages. The machine is then lifted on to the rail 800 having the clamping members 300 that is to be handled. The rail 800 will fit into a rail fit recess 503 of the machine 100, which has the form of an inverted U.

A batterie, (not shown), which may be carried separately, is positioned in a batterie holder 34, see FIG. 3, preferably positioned on top (not shown) of the housing 500. The batterie provides power to the electric motor 2 and also a control unit 33, e.g. attached to upper side of the housing 500.

Now the machine 1 is ready to be operated. First it is operated to position the contact members 403, 703 at a desired position in relation to the clamping member that are to be handled, e.g. to be pushed in as shown in FIG. 1. Once the machine is started the electric motor 2 starts spinning where by the rotation will be transmitted first to the planetary gearing 31 and then to the chain/wheel gear 32 to rotate the drive shaft 6 in a first direction, whereby the lever arms 400, 700 will start moving towards each other and start pushing the clamping elements 300 against each other to securely clamp the rail 800.

To remove clamps 300 from the rail 800 the machine is operated in a similar manner, but starting with the lever arms 400, 700 in an inner position to have the contact devices 703 of the second lever arms 700 to to be inside of and in level with the clamping members 300. Thereafter the machine 100 is started and rotated in a second direction.

Preferably a harmonic planetary gear is used that provides a gear ratio of at least 1:100 and an electric motor 2 rotating with at least 3000 rpm, preferably about 4000-6000 rpm. The invention is not limited to the examples described above. For instance, it is foreseen that various transmission gears may be used to achieve the desires function, e.g. a worm wheel gear, or traditional dented wheels.

The invention claimed is:

1. A rail clamp handling arrangement, for moving a clamping element from a position in which said element fastens a rail to a railroad sleeper to a sleeper releasing position or vise-versa, comprising:

a support structure having a lower part with a central rail fitting recess and arranged to extend transversally in relation to the longitudinal extension of the rail, wherein at each outer end portion of said lower part there is arranged connection means that provide pivot points at an intermediate point of a pair of pivotable lever arms, said pair of lever arms being arranged mirror symmetrically, a power and transmission arrangement arranged to simultaneously move an upper part of said lever arms via an upper pivotal connection, a lower part of said lever arms comprising contact devices arranged to move a clamping element, wherein said power and transmission arrangement includes a power unit in the form of an electric motor and a rotatable threaded shaft having oppositely arranged threads to transfer torque applied via said power and transmission arrangement into pivotal mirror wise movement of said lever arms.

2. The rail clamp handling arrangement according to claim 1, wherein there are arranged two pairs of connection means that provide pivot points at an intermediate point of two pairs of pivotable lever arms, said pair of lever arms being arranged mirror symmetrically, wherein one pair is arranged to attach clamps and another pair is arranged to detach clamps.

3. The rail clamp handling arrangement according to claim 1, wherein said power and transmission arrangement includes a chain/wheel gear mechanism.

4. The rail clamp handling arrangement according to claim 1, wherein said power and transmission arrangement includes a planetary gear.

5. The rail clamp handling arrangement according to claim 4, wherein the outgoing member of said planetary gear is directly connected to at least one chain wheels.

6. The rail clamp handling arrangement according to claim 5, wherein the outgoing member of said planetary gear is directly connected to a pair of chain wheels each driving at least one rotatable rod via a chain/wheel.

7. The rail clamp handling arrangement according to claim 4, wherein said chain/wheel gear, is arranged with an outgoing member fixedly connected to a ring wheel of said planetary gear.

8. The rail clamp handling arrangement according to claim 1, wherein said rotatable threaded shaft is fixedly positioned in relation to said transmission mechanism and that said rotatable threaded shaft centrally is arranged with a drive sleeve rotation wise, fixedly attached to said shaft.

9. The rail clamp handling arrangement according to claim 1, wherein said drive sleeve is arranged to be driven by means of said chain/wheel gear.

* * * * *